United States Patent [19]

Kraeutler

[11] Patent Number: 4,934,437

[45] Date of Patent: Jun. 19, 1990

[54] DRAFT-PROOF FLEXIBLE CURTAIN FOR A CONCERTINA-TYPE DOOR

[76] Inventor: Bernard Kraeutler, B.P. 6, 43220 Dunieres, France

[21] Appl. No.: 832,799

[22] Filed: Feb. 25, 1986

[30] Foreign Application Priority Data

Feb. 27, 1985 [FR] France ..... 85 02826

[51] Int. Cl.[5] ..... E06B 3/94

[52] U.S. Cl. ..... 160/84.1; 160/264; 160/271

[58] Field of Search ..... 160/84 R, 133, 268 R, 160/270, 271, 272, 273 R, 264

[56] References Cited

U.S. PATENT DOCUMENTS

| | | | |
|---|---|---|---|
| 1,251,981 | 1/1918 | Lewis | 160/273 R |
| 2,349,226 | 5/1944 | Thomas | 160/273 R |
| 3,116,097 | 12/1963 | Novales | 160/271 X |
| 4,333,511 | 6/1982 | Johnston | 160/271 X |
| 4,397,347 | 8/1983 | Brabant | 160/84 R X |
| 4,398,585 | 8/1983 | Marlow | 160/271 X |
| 4,478,268 | 10/1984 | Palmer | 160/272 X |
| 4,550,758 | 11/1985 | Johnson et al. | 160/271 |

FOREIGN PATENT DOCUMENTS

| | | | |
|---|---|---|---|
| 2410117 | 7/1979 | France | 160/84 R |

*Primary Examiner*—David M. Purol
*Attorney, Agent, or Firm*—Sughrue, Mion, Zinn, Macpeak & Seas

[57] ABSTRACT

A flexible curtain (8) for a concertina-type door includes a strip (12) of flexible material running along each of its side edges and suitable for coming into contact with the bottoms of the edge-receiving grooves in each of the door posts (1). If the flexible curtain includes reinforcing bars (9) having guide-wheels (11) at their ends, the strips may include wheel-receiving gaps. Advantageously, the strips are constituted by brushes having long and flexible bristles. If the curtain has reinforcing bars which do not include guide-wheels (11) the reinforcing bars need not penetrate fully into the grooves in the door posts (1), thereby leaving room for the strips (12) to be constituted by the edges of the curtain (8) itself, with the curtain being wider than the distance separating the bottoms of the facing door post grooves. The strips (12) provide draft-proofing for the concertina-type door under all normal conditions, i.e. regardless of whether the outside pressure is greater than the inside pressure or vice versa, or there is substantially no pressure difference between the outside and the inside.

13 Claims, 3 Drawing Sheets

DRAFT-PROOF FLEXIBLE CURTAIN FOR A CONCERTINA-TYPE DOOR

The present invention relates to a draft-proof curtain for a concertina-type door.

BACKGROUND OF THE INVENTION

Flexible curtains for concertina-type doors already exist. Generally speaking, a door of this type comprises a flexible curtain made of reinforced plastic material, with the curtain being stiffened at regular intervals by reinforcing bars. The side edges of the curtain are guided during up and down movement by being received in vertically extending grooves as provided, for example, by channel section door posts. The reinforcing bars generally have wheels at their ends, thereby facilitating curtain folding and curtain deployment. The door is operated by a motor which drives a shaft having the top ends of door-raising straps fixed thereto. The bottom ends of the straps are fixed to the bottom reinforcing bar of the curtains, and some of the intermediate reinforcing bars are fitted with strap-guiding means, such as loops through which the straps pass freely.

These are two reasons why the above-described door is not draft-proof. Firstly, when the reinforcing bars have wheels at their ends, the wheels hold the side edges of the flexible curtain at a distance from the bottoms of the curtain-receiving grooves, thereby leaving gaps along the entire height of the side edges of the door, thereby allowing heat to be exchanged between the inside and the outside. Secondly, the side edges of the flexible curtain are not held tightly between the side walls of the grooves, since sufficient space must be left between the side walls of the grooves to receive the folds of the curtain when the door is fully open. This spacing is thus large relative to the thickness of the curtain when the curtain is fully deployed and the door is closed. In the closed position, the vertical side edges of the door are free to move backwards and forwards across the gap between the side walls of the grooves. Gusts of wind and other changes in pressure between the inside and the outside thus cause the door to flap back and forth.

Various solutions have already been proposed to improve the draft-proofing round the vertical edges of concertina-type doors. For example, proposals have been made to partially close the open slots of the side grooves by means of inwardly directed lips constituted by brushes having bristles that lie in horizontal planes and that extend obliquely relative to the side walls of the grooves. FIGS. 1, 2, and 3 are diagrammatic horizontal sections through three channel-section door posts 1 showing three implementations of such draft-proofing lips. FIG. 1 shows a post 1 having a single brush 2 extending inwardly from its outside flange. FIG. 2 shows a similar arrangement except that the brush 3 extends outwardly from the inside flange of the post. Finally, FIG. 3 shows a post having both an outside brush 2' and an inside brush 3'. The brushes have flexible bristles and provide good draft-proofing when pressed firmly against the flexible curtain. Unfortunately, the brushes are rarely pressed in a continuous manner against the curtain. Thus, good draft-proofing is only obtained when there is enough excess outside pressure (usually wind) to press the door against the inside brushes 3 or 3' (FIG. 2 or 3), or when there is sufficient excess inside pressure to press the door against the outside brushes 2 or 2' (FIG. 1 or 3). When brushes are provided on both sides (the FIG. 3 configuration) it is still not possible to fit brushes which are long enough to ensure that one or other of the brushes is always pressed against the curtain, since that does not leave enough room for the curtain to fold concertina-like when the door is opened.

Another solution (described in French patent number 83 10970) consists in fitting one of the sides of each of the door-receiving grooves with a corresponding movable draft-proofing device which is automatically pressed against the corresponding side edge of the flexible curtain when the door is fully closed, thereby pressing the curtain against the other sides of the grooves, which other sides may advantageously be fitted with brushes similar to those described above. This provides draft-proofing. However, the equipment required is complex, and thus expensive.

A problem common to the brush-only solutions described with reference to FIGS. 1 to 3 is that since the brushes are fixed (regardless of which one of the sides of the grooves they are fitted to), they have to co-operate with a moving curtain. This considerably reduces their efficiency.

Preferred embodiments of the present invention avoid the above-mentioned drawbacks.

SUMMARY OF THE INVENTION

The present invention provides a concertina-type door with moving draft-proofing members, which members are not fixed to the grooves which receive the edges of the door as described above, but are fixed, instead, to the curtain itself. Each of the side edges of the flexible curtain in a door in accordance with the invention includes a strip of flexible material suitable for pressing against the bottom of the groove in which the edge is received. If some of the reinforcing bars have guide wheels at their ends, the strip of flexible material may have gaps to receive the wheels, and in any case the strips must extend in the sideways direction further than do the wheels, in order to prevent the wheels from lifting the flexible strips away from the bottoms of the grooves. In alternative embodiments, the ends of the reinforcing bars do not extend as far as the bottoms of the grooves (e.g. they extend only part of the way into the grooves), thereby enabling the draft-proofing strips to be constituted by the edges of the curtain itself, with the overall width of the curtain being greater than the distance between the bottoms of the grooves on either side thereof.

BRIEF DESCRIPTION OF THE DRAWINGS

Embodiments of the invention are described with reference to the accompanying drawings, in which.

MORE DETAILED DESCRIPTION

Figure 1:
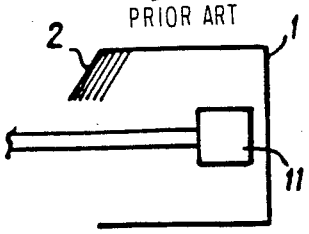
Fig. 1 PRIOR ART
FIGS. 1 to 3 are diagrammatic horizontal sections through three variants of prior art door posts for concertina-type doors.
Figure 2:
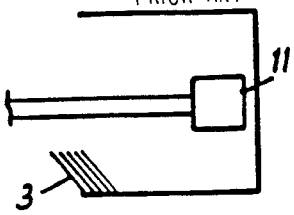
Fig. 2 PRIOR ART
Figure 3:
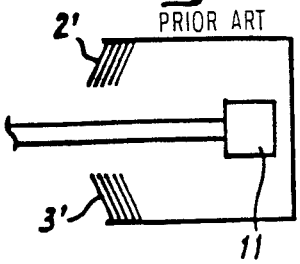
Fig. 3 PRIOR ART
Figure 4:
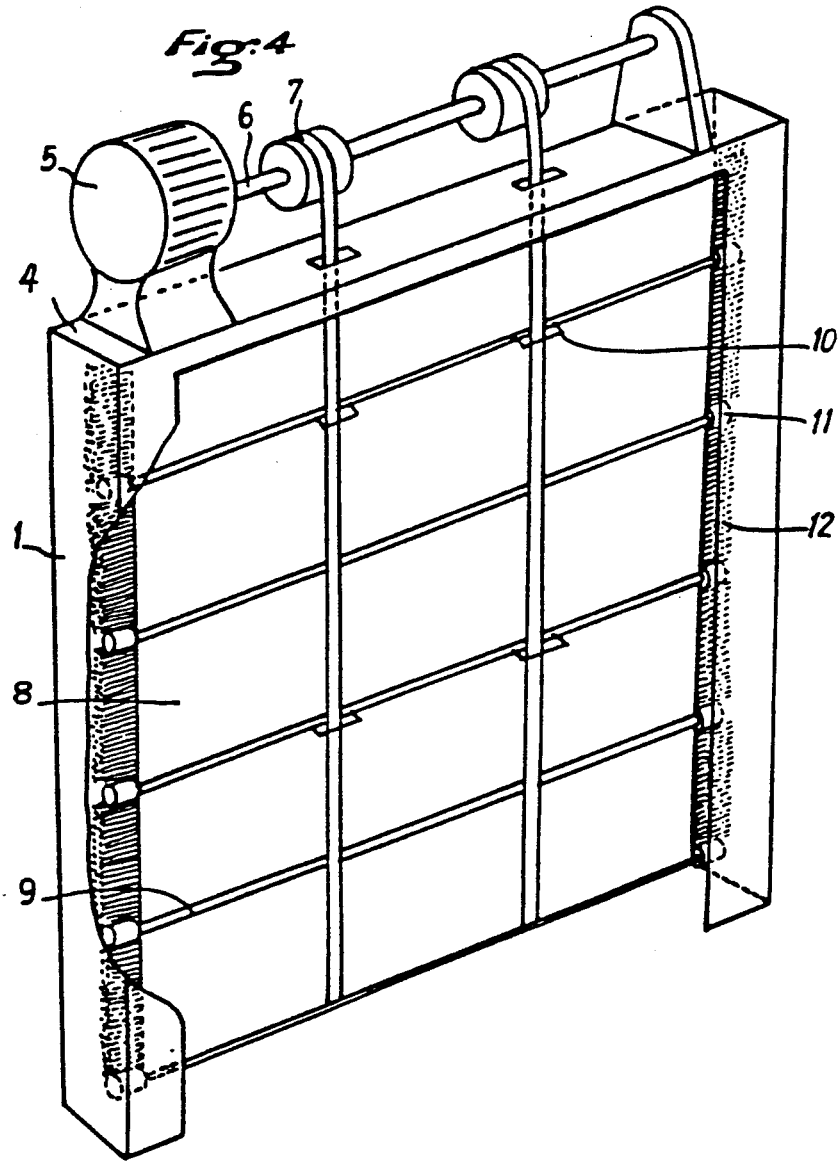
FIG. 4 is a partially cutaway diagrammatic perspective view of a concertina-type door fitted with draft-proofing members in accordance with the invention.

FIG. 4 shows the main items constituting a concertina-type door. The door has channel-section door posts 1 with their grooves facing each other in order to receive opposite side edges of the door. The tops of the posts 1 are interconnected by a cross-beam 4. A motor 5 is mounted on the cross-beam 4 and drives a shaft 6 for winding up door-lifting straps 7. A flexible curtain 8 hangs down from the cross-beam 4 and the side edges thereof are received in the grooves of the door posts 1. The curtain 8 is reinforced at regular intervals by horizontally extending reinforcing bars 9 which are received in individual pockets extending across the curtain. Some of the reinforcing bars 9 have guides 10 through which the lifting straps 7 are passed. Wheels 11 are fixed to the ends of the reinforcing bars 9.

Figure 5:
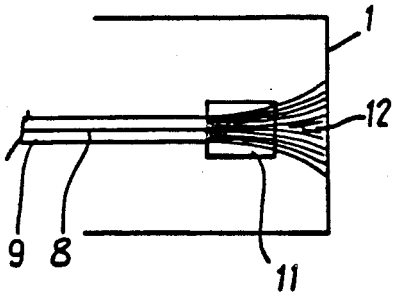
FIG. 5 is a diagrammatic horizontal section through one embodiment of the invention received in a door post.

In addition to the above-described conventional features of a concertina-type door, the door shown in FIG. 4 further includes draft-proofing members in accordance with the invention. These members are constituted by two strips 12 of flexible material fixed along respective ones of the side edges of the flexible curtain, and including gaps (in the FIG. 4 embodiment) for receiving each of the wheels 11. The strips 12 are wide enough to ensure that they come into contact with the bottoms of the grooves in the posts 1. The strips 12 thus project further in the sideways direction of the curtain than do the wheels 11. The strips may be constituted by continuous rubber tape or by rubber tape having notches in its outermost edge. Two or more of such notched tapes may be stacked together, in which case the notches are advantageously staggered relative to one another. The strip may also be constituted by a brush of long and flexible bristles (as shown in FIGS. 4 and 5) or by any other flexible material of any shape which is suitable for performing the same draft-proofing functions. In the embodiment shown in FIGS. 4 and 5, the strips 12 are constituted by brushes of long and flexible bristles which have the advantage of providing good draft-proofing for relatively low friction against the bottoms of the grooves.

Figure 6:
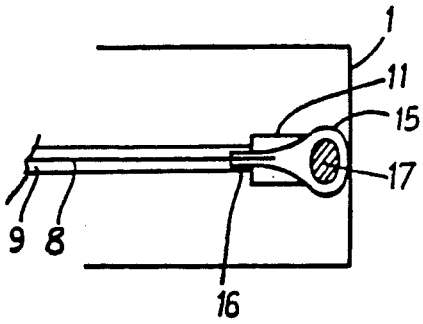
FIG. 6 is a similar view to FIG. 5 showing a second embodiment of the invention.

In a second embodiment, shown in FIG. 6, each flexible strip 12 is constituted by a tape 15 which is folded lengthwise over itself to reduce its overall width and to bring its longitudinal edges 16 opposite each other, with these edges being disposed on either side of a side edge of the flexible curtain 8. A core 17 of resilient foam may optionally be received inside the fold of the tape 15.

The strips 12 may be fixed to the edges of the curtain 8 in various ways. They may be glued in place, stitched, both stitched and glued, welded, or stapled. Naturally, where gaps are left to receive the wheels 11 at the ends of the reinforcing bars 9, each portion of the strips 12 is individually fixed to the edge of the curtain 8 extending between two adjacent reinforcing bars. If the flexible curtain 8 is itself constituted by an assembly of two sheets of suitable material (plasticized cloth, reinforced plastic, etc.), it appears to be advantageous for each portion of strip 12 to be sandwiched between the edges of said two sheets and for the assembly to be stitched together. If the strip is constituted by a tape which is folded lengthwise (FIG. 6), both edges of the tape may be stitched to the edge of the curtain, or else they may be stapled or glued or welded thereto. Two fixing means may be used together, e.g. staples and gluing.

Figure 7:
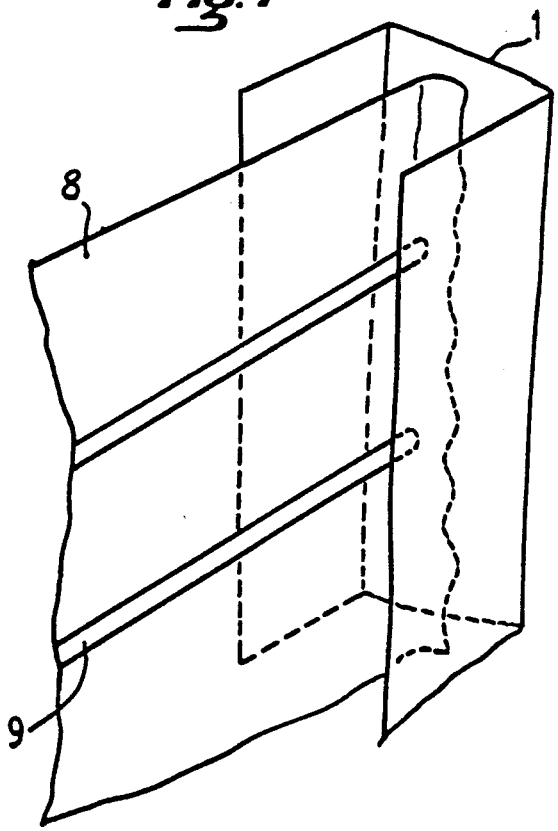
FIG. 7 is a diagrammatic perspective view showing a portion of a third embodiment of the invention.

In the embodiments of the invention shown in FIG. 7, the reinforcing bars 9 do not have wheels at their ends and they penetrate only partially into the grooves in the door posts 1. The pockets in which the reinforcing bars 9 are received are then closed at one end. The bars 9 are inserted into said pockets via their opposite open ends which are subsequently closed by a pressure tab or by a patch which may be held by glue or by hot gluing. With a curtain of this type, the draft-proofing strips 12 along the edges of the curtain are no longer added to the curtain as in the above-described embodiments of the invention, but are constituted by the side edges of the flexible curtain 8 itself, which curtain is therefore wider than the distance separating the bottoms of the grooves in the door posts. For example, the curtain may be 20 centimeters wider than said distance.

Figure 8:
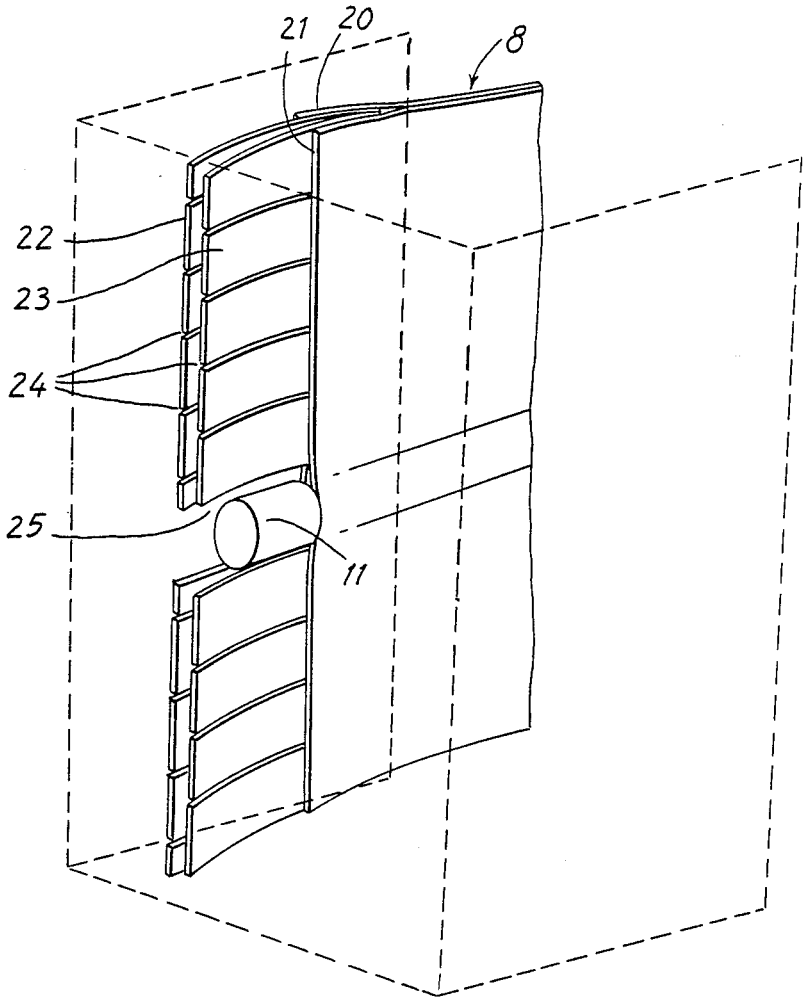
FIG. 8 is a diagrammatic perspective view showing a portion of a fourth embodiment of the invention.

In the embodiment of the invention shown in FIG. 8, the curtain 8 is constituted by an assembly of two sheets 20, 21. The strip is constituted by a stack of two assembled tapes 22, 23 of flexible rubber including notches 24 across their widths, said notches 24 being longitudinally offset from one another. The strip is sandwiched between said curtain constituting sheets 20, 21, and includes gaps 25 for receiving the wheels 11 of the reinforcing bars 9.

The present invention is not limited to the above-described embodiments, and numerous variants will occur to the person skilled in the art while remaining within the scope of the accompanying claims.

I claim:

1. In a draft-proof flexible curtain for a concertina-type door including two posts having tops and facing and vertically extending grooves for receiving respective side edges of said curtain, the tops of said posts being interconnected by a horizontal beam, said door further including a motor for driving a shaft to wind up door-lifting straps, and a flexible curtain which is stiffened at regular intervals by reinforcing bars including a bottom reinforcing bar, said lifting straps being fixed to the bottom reinforcing bar and being guided via guides located on at least some of said reinforcing bars, the improvement wherein said curtain comprises respective draft-proofing strips located along its side edges, said strips being made of flexible material and coming into contact with the bottoms of said edge-receiving grooves.

2. A draft-proof flexible curtain according to claim 1, wherein at least some of said reinforcing bars have wheels at their ends, and wherein said draft-proofing strips include gaps for receiving said wheels.

3. A draft-proof flexible curtain according to claim 1, wherein each strip is made of flexible rubber tape.

4. A draft-proof flexible curtain according to claim 3, wherein the flexible rubber tape includes notches extending across its width.

5. A draft-proof flexible curtain according to claim 1, wherein each strip is constituted by a stack of at least two assembled tapes of flexible rubber including notches across their widths, said notches being longitudinally offset from one another.

6. A draft-proof flexible curtain according to claim 1, wherein each strip is constituted by a brush having long and flexible bristles.

7. A draft-proof flexible curtain according to claim 1, wherein each strip is fixed to the inside surface of the flexible curtain.

8. A draft-proof flexible curtain according to claim 1, wherein each strip is fixed to the outside surface of the flexible curtain.

9. A draft-proof flexible curtain according to claim 1, wherein said curtain is constituted by an assembly of two sheets of suitable material, and wherein each of said draft-proofing strips is sandwiched between said sheets.

10. A draft-proof flexible curtain according to claim 1, wherein each draft-proofing strip is constituted by a tape which is folded lengthwise over itself so that its longitudinally extending edges are fixed to respective opposite faces of one of the side edges of the flexible curtain.

11. A draft-proof flexible curtain according to claim 10, wherein a resilient core foam is lodged in the fold in said tape.

12. A draft-proof flexible curtain according to claim 1, wherein said reinforcing bars penetrate only partially into said grooves in said door posts, and wherein said draft-proofing strips are constituted by the edges of the curtain itself, said curtain being wider than the distance between the bottoms of said grooves.

13. A draft-proof flexible curtain according to claim 12, wherein the width of the flexible curtain is about 20 centimeters greater than said distance between the bottoms of said grooves.

* * * * *